US011738474B2

(12) United States Patent
Van Veldhuizen

(10) Patent No.: US 11,738,474 B2
(45) Date of Patent: Aug. 29, 2023

(54) ATTACHMENT COMB FOR A HAIR CUTTING DEVICE

(71) Applicant: KONINKLIJKE PHILIPS N.V., Eindhoven (NL)

(72) Inventor: Gijsbert Hendrik Van Veldhuizen, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 43 days.

(21) Appl. No.: 17/277,947

(22) PCT Filed: Sep. 27, 2019

(86) PCT No.: PCT/EP2019/076274
§ 371 (c)(1),
(2) Date: Mar. 19, 2021

(87) PCT Pub. No.: WO2020/074282
PCT Pub. Date: Apr. 16, 2020

(65) Prior Publication Data

US 2021/0347075 A1 Nov. 11, 2021

(30) Foreign Application Priority Data

Oct. 10, 2018 (EP) ..... 18199666

(51) Int. Cl.
*B26B 19/20* (2006.01)

(52) U.S. Cl.
CPC ..... *B26B 19/20* (2013.01)

(58) Field of Classification Search
CPC ..... B26B 19/20; B26B 19/22; B26B 19/3826; B26B 21/4043
(Continued)

(56) References Cited

U.S. PATENT DOCUMENTS 336,890 A * 3/1886 Burwell ..... B26B 19/20 30/200
481,977 A 9/1892 Smith
(Continued)

FOREIGN PATENT DOCUMENTS

CN 205600784 * 9/2016
CN 206277422 6/2017
(Continued)

OTHER PUBLICATIONS

International Search Report and Written Opinion dated Dec. 17, 2019 for International Application No. PCT/EP2019/076274 Filed Sep. 27, 2019.

*Primary Examiner* — Ghassem Alie
*Assistant Examiner* — Samuel A Davies

(57) ABSTRACT

A releasable attachment comb coupled to a cutting head of a hair cutting device providing an adjustable hair cutting length. The attachment comb comprising clamping elements disposed at opposite ends of a support bar a set of comb teeth arrayed along the support bar between the clamping elements. Locating/retaining notches provided on opposing inner faces of the clamping element defining a series of clamping positions to receive and lock a cutting element of the cutting head. The locating notches arranged on the opposed inner faces of the clamping elements defining between them a sloped clamping plane for the cutting element. The notches defining clamping positions at multiple points along the sloped plane. The clamping elements adapted to be displaceable away from one another so as to displace the respective notches of each clamping element away from one another, thereby permitting release and advancement of a received cutting element from one clamping position to another.

12 Claims, 5 Drawing Sheets

(58) Field of Classification Search
USPC ..... D28/44.2
See application file for complete search history.

(56) References Cited

U.S. PATENT DOCUMENTS 532,335 A * 1/1895 Priest ..... B26B 19/20 30/200
708,464 A * 9/1902 Coates ..... B26B 19/20 30/200
723,650 A * 3/1903 Coates ..... B26B 19/20 30/200
1,621,572 A 3/1927 Young
1,628,421 A * 5/1927 Patenaude ..... B26B 19/20 30/200
2,317,928 A * 4/1943 Martell ..... B26B 19/20 30/200
2,802,263 A * 8/1957 Marchner ..... B26B 19/20 30/201
2,916,820 A 12/1959 Clark
3,145,470 A * 8/1964 Hoffman ..... B26B 19/20 30/200
3,177,582 A * 4/1965 Curtis ..... B26B 29/00 D28/47
3,209,455 A * 10/1965 Gnage ..... B26B 19/20 30/200
3,295,201 A * 1/1967 Pucino ..... B26B 19/20 30/200
3,648,370 A * 3/1972 Cercone ..... B26B 19/20 30/201
4,622,745 A 11/1986 Wahl
5,893,213 A * 4/1999 Motta ..... B26B 21/4037 30/539
7,275,461 B2 * 10/2007 Gherman ..... B24D 15/10 76/82
10,337,132 B1 * 7/2019 Mathis ..... D06C 13/00
2004/0172829 A1 * 9/2004 Kuechler ..... B26B 19/20 30/34.2
2011/0225833 A1 * 9/2011 Hoffman ..... B26B 21/4037 30/538
2012/0240414 A1 * 9/2012 Wevers ..... B26B 19/063 30/201
2014/0215832 A1 * 8/2014 Julemont ..... A45D 24/36 30/200
2016/0199988 A1 * 7/2016 Altomare ..... B26B 19/3873 83/13
2017/0361476 A1 * 12/2017 Phoon ..... B26B 19/063

FOREIGN PATENT DOCUMENTS

DE 3623591 A1 * 7/1986
DE 3623591 1/1988
EP 0176372 4/1986
JP S5371973 A 6/1978
JP 2001232075 8/2001
JP 2012125514 A * 7/2012 ..... B26B 19/20
WO 2014103178 7/2014

* cited by examiner

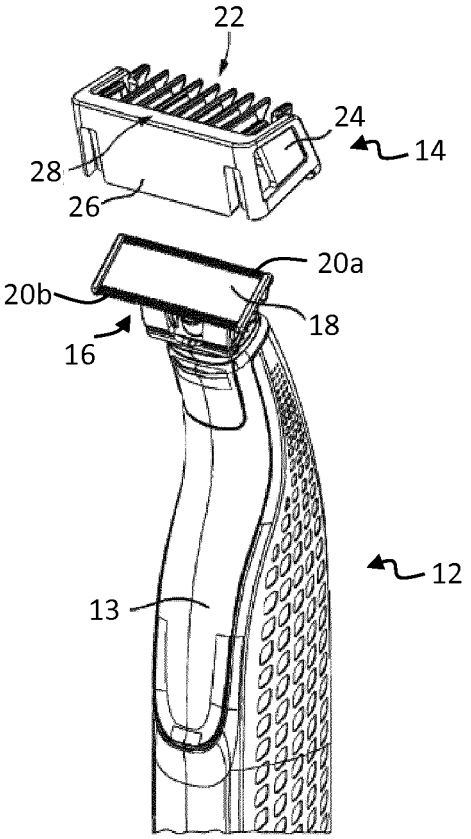
FIG. 1 – PRIOR ART
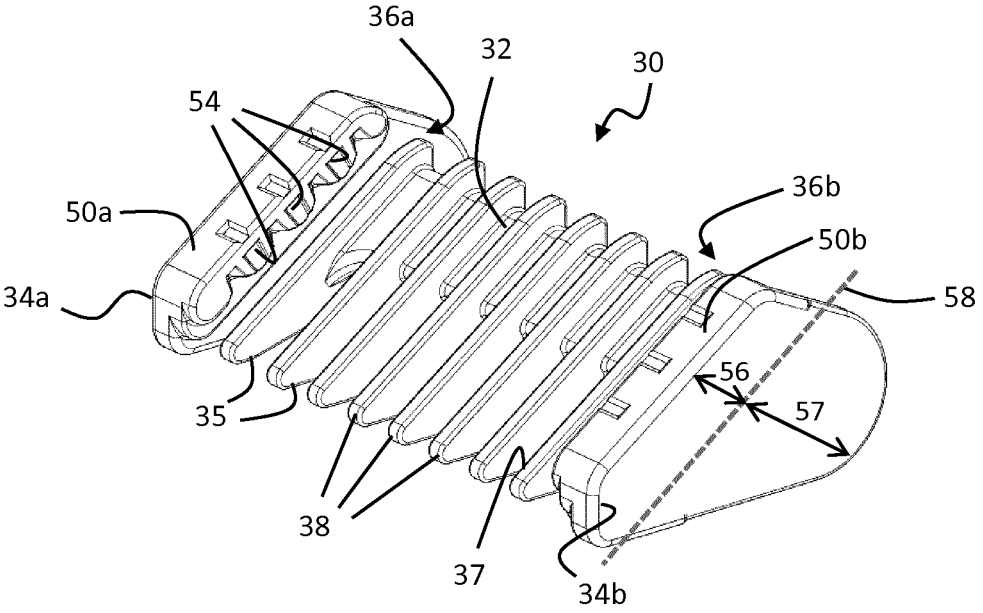
FIG. 2

ATTACHMENT COMB FOR A HAIR CUTTING DEVICE

CROSS REFERENCE TO RELATED APPLICATIONS

This application is the U.S. National Phase application under 35 U.S.C. § 371 of International Application No. PCT/EP2019/076274 filed Sep. 27, 2019, which claims the benefit of European Patent Application Number 18199666.1 filed Oct. 10, 2018. These applications are hereby incorporated by reference herein.

FIELD OF THE INVENTION

The present invention relates to an attachment comb for a hair cutting device.

BACKGROUND OF THE INVENTION

Hair cutting devices for cutting or trimming hair typically include a cutting element mounted within a cutting head, and the cutting head configured for sliding over skin of a user to slice hair at the level of the skin. Hair cutting devices may in particular comprise a planar cutting element, having cutting edges, e.g. toothed cutting edges, and arranged to cut hairs as the element is passed over skin. In some cases the planar cutting element includes a stationary blade and a cutter blade placed one atop the other, and where the cutter blade is driven to move with respect to the stationary blade, in reciprocating motion, respective toothed cutting edges of the blades overlapping and cutting off hairs trapped between them in a scissor action.

It is common to use an attachment comb in combination with a hair cutting device for configuring a length to which hair is cut. The attachment comb in particular typically comprises a set of comb teeth which define a skin engaging face on one side, and which is shaped to receive and support a cutting element at a defined height from the skin engaging face, to thereby set a defined length of hair cut by the hair cutting device. The attachment comb is releasable from the cutting head of the cutting device, to permit non-combed cutting operation or to allow switching between different attachment combs providing different hair cutting settings.

For illustration an example hair cutting device and attachment comb known from the prior art is shown in FIG. 1. The hair cutting device 12 has a body part 13 shaped to provide a gripping handle for the device, and a cutting head 16 attached to an end of the body part, the cutting head carrying a cutting element 18, in this case in the form of a planar blade set formed of a cutting blade placed atop a stationary blade. The blades have respective toothed cutting edges 20*a*, 20*b* on either side which overlap. An example attachment comb 14 is shown adapted to releasably couple to the cutting head 16. The attachment comb has a set of comb teeth 22 arrayed between end panels 24 and partially housed by the end panels in combination with a back panel 26. The comb teeth define a skin engaging face 28 for the comb part which can be slid over skin of a user in user to cut hair.

Current hair cutting devices and combs, such as that shown in FIG. 1, are typically configured for cutting hair at one fixed length, usually defined by the dimensions or geometry of the cutting device or comb. Some devices or combs are known which allow an adjustable hair length to be set. However these require complex mechanisms of multiple parts to facilitate switching of hair length setting.

EP 176 372 A1, DE 36 23 591 A1 and U.S. 481 977 disclose hair clippers with attachment combs in which attachment position of the comb to the clipper defines the cutting length. Unfortunately the adjustment of these combs is not straightforward.

Improved means for facilitating adjustable hair cutting length is therefore desired.

SUMMARY OF THE INVENTION

The invention is defined by the claims.

According to examples in accordance with an aspect of the invention, there is provided a releasable attachment comb for attachment to a hair cutting device having a cutting element, the attachment comb comprising:

a support frame comprising a support bar, and first and second clamping elements located at respective opposite ends of the support bar, for clamping the attachment comb about ends of the cutting element in use;

the clamping elements having respective interior faces opposing one another, each of the opposed interior faces comprising a set of locating notches, the two sets of locating notches defining a clamping plane therebetween, the attachment comb further comprising an array of comb teeth, mounted to the support bar between the first and second clamping elements, lower edges of the comb teeth defining a skin contact area for the attachment comb, wherein the clamping plane is sloped with respect to the skin contact area, and wherein the locating notches define between the clamping elements a series of clamping positions for the cutting element, at different points along the clamping plane; and wherein the clamping elements are at least partially displaceable away from one another to permit in use release and slidable advancement of the cutting element along the clamping plane between the clamping positions.

Embodiments of the invention are based on provision of an attachment comb having fixation notches which define between them an angled slope and the comb being attachable to a cutting element at multiple positions along the slope, where each position, due to the angled slope, provides a different hair cutting length. The cutting element can be slid to different positions along the slope, and retained in place by means of the locating notches which define various clamping positions for the cutting element providing associated fixed cutting lengths.

Easy adjustment between different length settings is facilitated by the locating notch arrangement and displaceable clamping elements. By displacing the clamping elements away from one another, the notches on either side are moved apart, thereby permitting or easing release of a clamped cutting element from a particular pair of locating notches in which it is held. The cutting element can then slide along the sloped clamping plane defined between the opposed sets of notches to a different position along the slope, thereby changing a cutting height.

In examples, upper edges of the comb teeth may also define a sloped plane with respect to the skin contact area. In certain examples, the clamping plane may extend parallel to this sloped plane of the comb teeth. In certain examples, the arrangement may be such that the clamping element is slidable over the top of sloped upper surface of the comb teeth, i.e. in sliding contact with the comb teeth.

According to examples, the set of locating notches on each of the opposed interior faces of the clamping elements may extend in a respective line. The clamping plane may be defined between said respective lines of notches.

The clamping elements are flexible, to permit bending of the opposed sets of locating notches away from one another, to thereby permit release and advancement of the clamping position.

In this case the clamping elements are deformable, and release of the cutting element is achieved by deforming the notches of the opposed clamping elements away from one another. This provides a highly simple mechanism for achieving the notch displacement, and furthermore can be provided by an attachment comb formed as a single unitary piece.

The clamping elements are flexible about the support bar, to permit bending of an opposed set of first end portions of the clamping elements away from another, by applying an inward pinching action at opposed second end portions of the clamping elements. End portions may mean sections of ends of the clamping elements, extending from an extreme edge or end of a given clamping element and inward some distance.

The first and second end portions may be at opposite first and second ends of the support bar.

In this case, the clamping elements effectively provide a pinch and snap attachment mechanism, wherein the clamping elements can be pinched together at one set of ends, to thereby push apart the alternate ends, the alternate ends carrying on their inner faces the co-operating locating notches.

In particular, the clamping elements effectively form end pieces having an inner notch side and an outer interface side. The clamping elements are in this example coupled to the support bar in manner such that by pressing on the interface side, the notch side bends in a direction away from the comb teeth. When performed on both clamping elements, e.g. through a pinching action, the notches on the two sides move away from one another.

Hence the attachment comb has interface parts on each clamping element disposed on an opposite face to that which carries the notches. This arrangement permits a convenient pinch and snap clamping mechanism.

In advantageous examples, at least portions of the support bar connecting to the clamping elements may have an elongate cross-section, a length dimension of said cross-section defining a bending axis for each of the clamping elements about the support bar. The elongate cross-section forms an elongate connecting or coupling point for each of the clamping elements to the support bar which defines a natural axis of bending about the support bar, the axis along the elongate (length) dimension of the cross-section.

The length dimension of the cross-section means the longest dimension. Elongate means having a length greater than the width. The elongate cross-section may for example be oval, rectangular, rounded rectangular or any other elongate shape.

The whole support bar may have the elongate cross-section in certain examples. This may provide for example for a substantially flat upper surface for the support bar, extending parallel with the length dimension of the elongate cross-section. This may provide an advantageous supporting surface for the array of comb teeth. The array of comb teeth may couple to the support bar via this upper surface.

According to advantageous embodiments, the support bar may include reduced cross-section end portions, to which the clamping elements connect. Reduced cross-section means reduced cross-sectional area end portions. This means the support bar includes end portions having reduced cross-sectional area relative to a remainder of the support bar, and wherein the clamping elements connect to the support bar via the reduced cross-section end portions.

Reduced means reduced relative to the remainder of the support bar, or at least relative to a portion of the support bar immediately adjacent the respective end portion. Hence, the end portions may have a smaller cross-sectional area than a remainder of the support bar, or at least than portions of the bar immediately adjacent.

By connecting each clamping element to the support bar by a reduced cross-section, or thinned, portion of the support bar, local bending of the clamping elements about the ends of the support bar may be straightforwardly facilitated. This avoids for instance a requirement to provide the entire comb attachment structure as a flexible structure, and instead localizes the area of material flexibility. This may allow for instance a remainder of the attachment comb structure to be provided more rigid, providing more robustness to the structure.

The notches of the attachment comb may define at least a series of straight clamping positions for holding a received cutting element extending perpendicularly between the clamping elements, e.g. parallel with the support bar. This means that the notches are configured such that the attachment comb is clampable to the cutting element in a series of positions in which the cutting element extends perpendicular between the clamping elements.

The sets of notches on the two clamping elements may hence be perpendicularly aligned with one another, i.e. each notch on the first clamping element being perpendicular aligned with a respective notch on the second clamping element. Alternatively, the clamping elements may together include at least a subset of notches being so aligned with one another.

Additionally or alternatively, the notches of the attachment comb may define a series of slanted clamping positions for holding a received cutting element extending diagonally between the clamping elements. This means that the notches are configured such that the attachment comb is clampable to the cutting element in a series of positions in which the cutting element extends diagonally between the clamping elements.

A diagonal cutting element arrangement facilitates creation of fades or fading in cut hair. Fading is a concept known within the field of hair trimming. Fading means creating a gradient in hair length. This faded effect results in a smooth overflow in hair length from no hair to a set hair length.

Most advantageously, the attachment comb permits both straight and slanted positions, multiple of each, and in combination with one another. In this way a clamping system is provided which supports both translational and rotational adjustment of a cutting element between the clamping elements, allowing different fading settings to be achievable in combination with different possible length settings all with a (e.g. single piece) attachment comb.

This hence provides an improvement over traditional fading combs, which are set at a specific length and cannot be used for trimming at different lengths.

The notches on each opposed interior face may be arranged in a line.

The line of notches on each opposed interior face may be open at one side, these sides opening onto a common channel which links the notches together.

The notches in each line may be open across respective upper sides, and the open upper sides opening onto a common channel which links the notches together. The channel may connect the notches continuously together.

This permits sliding of the cutting element easily between the different notches, and hence the different clamping positions, by simply sliding it along said channel linking the notches.

The channel may hence form a sliding channel.

Furthermore, this arrangement also eases adjustment between different diagonal positions of the cutting element. The cutting element can be easily twisted or rotated between the clamping elements by sliding ends of the cutting element in opposing directions along the two channels. This permits moving of the cutting element between different diagonal positions. Thus different diagonal positions can be achieved without removal of the cutting element from between the clamping elements.

The interior spaces of the linked notches and common channel may be so linked as to form a continuous sunken area in the interior face of the clamping element.

In particular examples, each of the notches may have at least one inclined interior side wall leading toward said common channel.

This facilitates easy sliding of ends of the cutting element in and out of notches and up into the common channel.

In some examples, each notch may comprise a flat base wall section from which the inclined side-walls upwardly extend. This flat base section supports a received cutting element stably in the defined clamping position, and also allows for free lateral sliding of the blade of the cutting element between the clamping elements, for cutting hair. Flat may mean parallel with the line along which the notches are arranged or aligned.

In some examples, the inclined sidewalls of neighboring notches in each line may be connected by a linking wall section, extending between respective upper ends of the neighboring side walls of the neighboring notches. The linking wall section provides an additional support point upon which an appropriate portion of a received cutting element may rest to further lock it stably into a given clamping position. The linking wall section may for example be flat to engage a flat portion of a cutting element. Flat may mean parallel with the line along which the (line of) notches is arranged or aligned. The linking wall section may in further examples for instance be peaked or pointed to engage a correspondingly shaped portion of a cutting element.

The line of notches includes end notches at respective ends of said line, the end notches each having on one side a rounded interior side wall forming an end to the line, and an inclined interior side wall on the other side. The end notches may be for supporting fixation of the cutting element in intermediate notches between the end notches. For example, the end notches may support fixation of (i.e. prevent release of) the cutting element when having end parts received in the notches immediately neighboring each of the end notches.

The rounded side wall may be for blocking further sliding of a cutting element along the line. The inclined sidewall extends toward a neighboring notch for easy sliding between the neighboring notches.

Examples in accordance with a further aspect of the invention provide a method of adjusting a coupling between a hair cutting device having a cutting element and a releasable attachment comb for the hair cutting device, the adjustment for adjusting a cutting setting of the hair cutting device, wherein the attachment comb comprises:

a support frame comprising a support bar, and first and second clamping elements located at respective opposite ends of the support bar, for clamping the comb unit about ends of the cutting element, the clamping elements having respective interior faces opposing one another, each of the opposed interior faces comprising a set of locating notches, the two sets of locating notches defining a clamping plane therebetween, the attachment comb further comprising an array of comb teeth, mounted to the support bar between the first and second clamping elements, lower edges of the comb teeth defining a skin contact area for the attachment comb, wherein the clamping plane is sloped with respect to the skin contact area, and wherein the locating notches define between the clamping elements a series of clamping positions for the cutting element, at different points along the clamping plane, and the method comprising: at least partially displacing the clamping elements away from one another to permit release of the cutting element from a first clamping position; slidably advancing of the cutting element along the clamping plane to move it to a second clamping position; and replacing the clamping elements back toward one another to thereby lock the cutting element in the second clamping position.

The slidable advancement of the cutting element may comprise rotating the cutting element within the clamping plane (for example slidingly over the array of comb teeth), so as to move the cutting element to a second clamping position having the cutting element extending diagonally between the clamping elements. Thus different fade settings can be switched between.

Examples in accordance with a further aspect of the invention provide a hair cutting assembly comprising:

a releasable attachment comb in accordance with any of the examples or embodiments described above or below, or in accordance with any claim of the present application; and a hair cutting device having a cutting element, the cutting device including engaging parts for engaging with notches of the releasable attachment comb, and the attachment comb being attached to the cutting device via said engaging parts.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which:

FIG. 1 shows a prior art cutting device and attachment comb;

FIG. 2 shows a perspective view of an example attachment comb according to one or more embodiments;

DETAILED DESCRIPTION OF THE EMBODIMENTS

Figure 3:
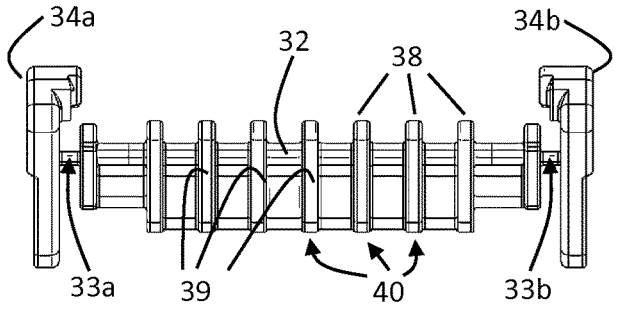
FIG. 3 shows a rear elevation of the example attachment comb of FIG. 1.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

A releasable attachment comb for coupling to a cutting head of a hair cutting device for the purpose of providing an adjustable hair cutting length. The attachment comb comprises clamping elements disposed at ends of a support bar, and with a set of comb teeth arrayed along the support bar between the clamping elements. Locating or retaining notches are provided on inner faces of the two clamping elements, in opposition to one another, and together define a series of clamping positions in which a cutting element of the cutting head may be received and locked. The locating notches on the opposed inner faces define between them a sloped plane, forming a clamping plane for the cutting element. The notches define clamping positions at multiple points up and down the plane. The clamping elements are adapted to be displaceable away from one another in a manner so as to displace the respective notches of each clamping element away from one another, the thereby permit release and advancement of a received cutting element from one clamping position to another.

Figure 4:
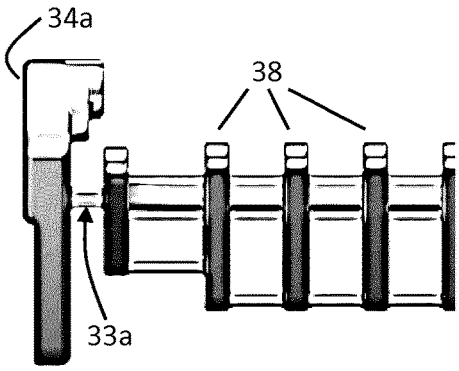
FIG. 4 shows a closer view of a portion of the rear elevation of the attachment comb.

FIGS. 2-4 illustrate an example attachment comb 30 according to an embodiment.

FIG. 2 shows a perspective view of the attachment comb 30.

FIG. 3 shows a rear elevation of the attachment comb 30.

FIG. 4 shows a closer view of one part of a rear side of the attachment comb 30.

The attachment comb 30 comprises a support frame comprising a support bar 32 extending between first 34*a* and second 34*b* end pieces, the end pieces forming clamping elements. The clamping elements are thus located at respective opposite ends of the support bar. The clamping elements are for clamping to ends of a cutting element in use, to secure the cutting element to the attachment comb. Each of the clamping elements has a respective inner (i.e. interior) face 36*a*, 36*b*, with the inner faces 36*a*, 36*b* of the two clamping elements arranged in opposition to one another (i.e. facing toward one another).

Formed on the interior faces 36*a*, 36*a* of each of the clamping elements 34*a*, 34*b* is a respective set of locating notches 54 for locating engaging parts of ends of a cutting element in use. In FIG. 2 only the locating notches on the first 34*a* clamping element are visible, however each clamping element has a respective set of locating notches. The two sets of locating notches define between them a clamping plane, the clamping plane being sloped with respect to a skin contact area defined at a base of the attachment comb.

The locating notches 54 define between the clamping elements 34*a*, 34*b* a series of clamping positions for the cutting element, at different points along the clamping plane. In use, the clamping elements are at least partially displaceable away from one another to permit release and slidable advancement of the cutting element along the clamping plane between the different clamping positions.

Mounted to the support bar 32 and arrayed between the first 34*a* and second 34*b* clamping elements is an array of comb teeth 38 or comb fingers. The comb teeth 38 have sloped upper edges 37 together defining a sloped or inclined plane. In this example, the locating notches 54 on each clamping element extend alongside side edges of the sloped plane formed by the comb teeth 38. Thus in this examples, the clamping plane defined between the sets of locating notches extends substantially parallel with the sloped plane defined by the upper edges 37 of the comb teeth 38. The arrangement may be such that a lower surface of a received clamping element in use slides over the sloped upper edges 37 of the comb teeth as it is slid between different clamping positions within the clamping plane.

However, this represents just one example, and in alternative examples the clamping plane may not run parallel with the sloped plane of the comb teeth. The upper edges of the comb teeth may or may not be sloped.

The shape of the comb teeth in the present example means that the array of teeth has an overall wedge shape, each comb tooth having a rear 39 and underside edge 40 which meet at substantially a right angle at a rear lower corner of the comb array and join to opposing ends of the upper sloped edge. The rear and underside edges may meet at a curved corner.

The clamping elements 34*a*, 34*b* in this example also each have an outer shape or outline which is generally wedge shaped, following a similar outline to the that of the array of comb teeth arrayed between them. Each in particular has an inclined or sloped upper edge 50*a*, 50*b* which follows parallel to the slope angle of the clamping plane defined between the sets of notches 54. It also in the present example runs parallel with the sloped plane defined by upper edges 37 of the comb teeth 38. The clamping elements in this example essentially form end panels or tabs having an outline shape which substantially follows (or is similar to) the outline shape of the array of comb teeth, although being slightly larger so as to extend around or encompass the array of teeth. The particular shape of the clamping elements however is not essential to the invention, and this example provides just one advantageous configuration.

In this example, the locating notches on the inner face 36*a*, 36*b* of each clamping element 34*a*, 34*b* are arranged extending in a line. In particular, notches on each clamping element inner face are arranged extending in a (sloped) line. This slope effectively defines the slope of the clamping plane defined between the respective sets of notches 54 of the first and second clamping elements. The slope also in this example runs substantially parallel to the slope of the comb teeth 38. In this way, on an inner face of each clamping element is a line of notches extending alongside and parallel to side edges of the inclined plane formed by the comb teeth 38. In this way, the clamping plane runs substantially parallel in this example to a sloped upper surface of the array of comb teeth 38, The notches in this example are situated at a region of each inner face slightly raised above the sloped plane of the comb teeth, i.e. above the sloped upper edges 37 of the comb teeth. This thereby means that the notches in this example define locating positions for a cutting element at different resting positions along the top of the sloped tooth edges 37. This particular arrangement is not essential however.

The clamping elements 34*a*, 34*b* are at least partially displaceable away from one another to permit in use release and slidable advancement of a received cutting element along the clamping plane between the different clamping positions defined by the notches. In particular, at least the regions of the clamping elements 34*a*, 34*b* at which the locating notches are positioned are displaceable away from one another.

In particular, in the present example, the clamping elements 34*a*, 34*b* are deformable or flexible to permit bending of the inner faces 36*a*, 36*b*, of the clamping elements away from one another. Hence the clamping elements are deformable to permit deforming of the notches 54 of the two clamping elements away from one another, to thereby release a cutting element from one pair of locating notches, and permit it to be advanced along the clamping plane, over the top of the comb teeth 38, to another pair at another clamping position, or detached and removed from the attachment comb 30.

More particularly, in the present example, the clamping elements 34*a*, 34*b* are each flexible or deformable about the support bar 32, to permit bending of an opposed set of first end portions 56 of the clamping elements away from another, by applying an inward pinching action at opposed second end portions 57 of the clamping elements. In this way, the attachment comb provides a pinch and snap clamping mechanism, with the first end portions 56 (along which the notches are disposed) being manipulable between an outwardly bent, unlocked position, and a relaxed, locked, position. Line 58 indicates a bending axis about which the clamping element is bendable. This axis marks a delineation between the first end portion 56 and second end portion 57 of the clamping element.

More particularly still, the clamping elements 34*a*, 34*b* are connected to the support bar 32 via reduced cross-section end portions 33*a*, 33*b* of the support bar. These end portions have smaller cross-section (cross-sectional area) than a remaining (middle) portion of support bar, and are hence thinned compared to the rest of the support bar. By virtue of this the clamping elements naturally bend or deform about these end portions 33 when pressure is applied to the clamping element at either side 56, 57 of the support bar. These reduced cross-section portions hence facilitate pivotal bending of the clamping elements about the support bar without for example the requirement to provide the whole comb attachment 14 structure as a flexible structure. Instead, the material flexibility is localized, meaning a remainder of the support bar can be provided more rigid.

Each of the clamping elements 34*a*, 34*b* is mounted to the support bar 32 by a location on the interior face 36 of the clamping element positioned between the first end portion 56 of the clamping element, and the second end portion 57, with the notches 54 being located within said first end portion 56 and the second end portion 57 being free of notches. The second end portion 57 may hence form an interfacing or gripping or pinching part. The second end portions 57 may form pinching or gripping tabs for actuating bending of the first end portions 56, and the carried notches 54, away from one another. Outer or exterior faces of the second end portions 57 may thus form interfacing zones, or interface surfaces or areas. The second end portions 57 may include on respective outer or exterior faces gripping elements or surfaces, e.g. ribs, to facilitate gripping and pinching.

The end portions 33*a*, 33*b* of the support bar 32 connecting to the clamping elements 34*a*, 34*b* have an elongate cross-section. A length dimension of said cross-section may define the bending axis 58 for each of the clamping elements about the support bar. The elongate cross-section forms an elongate connecting or coupling area for each of the clamping elements to the support bar which defines a natural axis of bending 58 about the support bar, the axis being along the elongate (length) dimension of the cross-section.

The whole support bar 32 is this example has the elongate cross-section, although this is not essential. This may provide for example for a substantially flat upper surface for the support bar, extending parallel with the length dimension of the elongate cross-section. This provides an advantageous supporting surface for the array of comb teeth 38. The array of comb teeth couples to the support bar via this upper surface.

The attachment comb may be formed as a single piece, i.e. a single unitary body. Each of the clamping elements may be provided as a single unitary piece or body, being suitably deformable to provide the deformation effect.

The notches 54 are contiguously aligned with one another, with the sunken interior space formed by each notch being at least partially separated from that of neighboring notches by a boundary sidewall. In advantageous examples, the interior spaces of neighboring notches may be connected by a connecting channel, permitting easier sliding of engagement parts of a cutting element between different notches. In some cases, the interiors of the whole line of notches on each clamping element 34*a*, 34*b* may be connected by a common connecting channel. This will be explained in more detail below.

Figure 5:
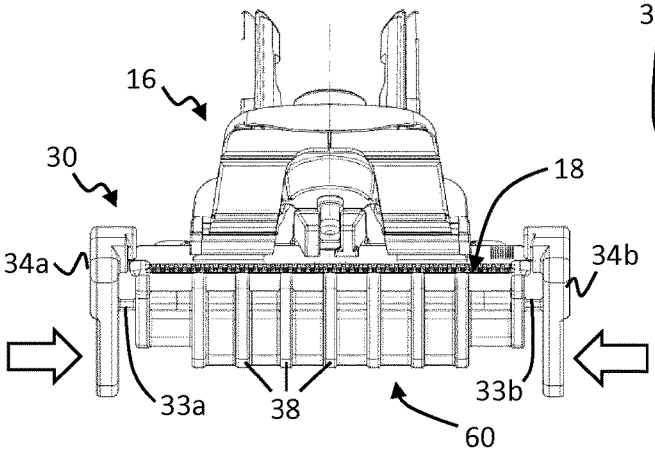
FIGS. 5 and 6 show the example attachment comb of FIGS. 2-4 in use, clamped to a cutting element of a cutting device.
Figure 6:
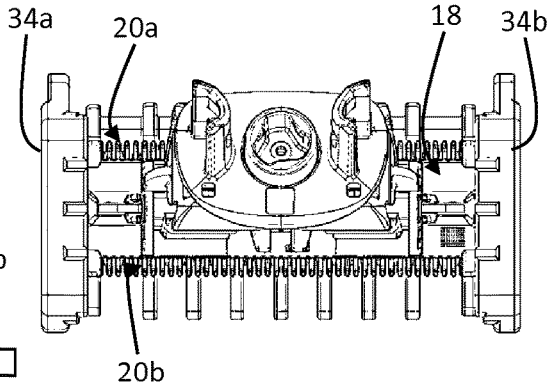

FIGS. 5 and 6 illustrate the attachment comb 30 of FIGS. 2-4 in use, in an attached configuration, clamped to a cutting element 18 of a cutting head 16 of a hair cutting device.

In use, a user applies inward pressure to exterior faces of the two clamping elements 34*a*, 34*b*, in particular to the exterior faces of the second end portions 57 in the present example, i.e. the interfacing end portions. By application of a pinching action between these areas of the clamping elements (as indicated by the large arrows in FIG. 5), the first end portions 56 of the clamping elements (which carry the notches 54) move apart. The notches are hence displaced away from one another.

A cutting element 18 of the cutting device may then be inserted between the clamping elements 34*a*, 34*b*, while the clamping elements are still in the open position. According to the particular example of FIGS. 2-4, a lower e.g. planar, face of the cutting element may be brought into engagement (in facing relationship) with the sloped upper edges 37 of the comb teeth 38. The cutting element may be slid along the sloped clamping plane to a desired height position, the different height positions being defined by respective pairs of opposed notches 54, one notch of each pair on each clamping element.

The cutting element may be moved between height (or clamping) positions by moving, e.g. sliding, engaging end parts of the cutting element between the different notch pairs, or displacing the notches sufficiently to bring the engaging parts completely out of the notches so that it can be slid freely to a new pair of notches. Once the required position is reached, with the engaging parts of the cutting element located in, or aligned with, an appropriate set of notches, the second ends 57 of the clamping elements may be released, to thereby bring the clamping elements back toward one another, and thus secure the cutting element between the clamping elements, holding it in place on the attachment comb.

The user may then operate the hair cutting device 12 with the attachment comb secured at the desired height setting, by sliding the cutting head 16 over the skin. In particular a lower skin engaging face 60 of the coupled attachment comb is brought into contact with the skin and slid over the skin to thereby draw the blade across hairs of the user, at the configured height setting.

Should a user wish to change the height setting, the process described above may be repeated, with the second ends 57 of the clamping elements pinched together to release the cutting element 18, and permit advancement of the cutting element in sliding fashion over the sloped teeth 38 to a new position.

Figure 7:
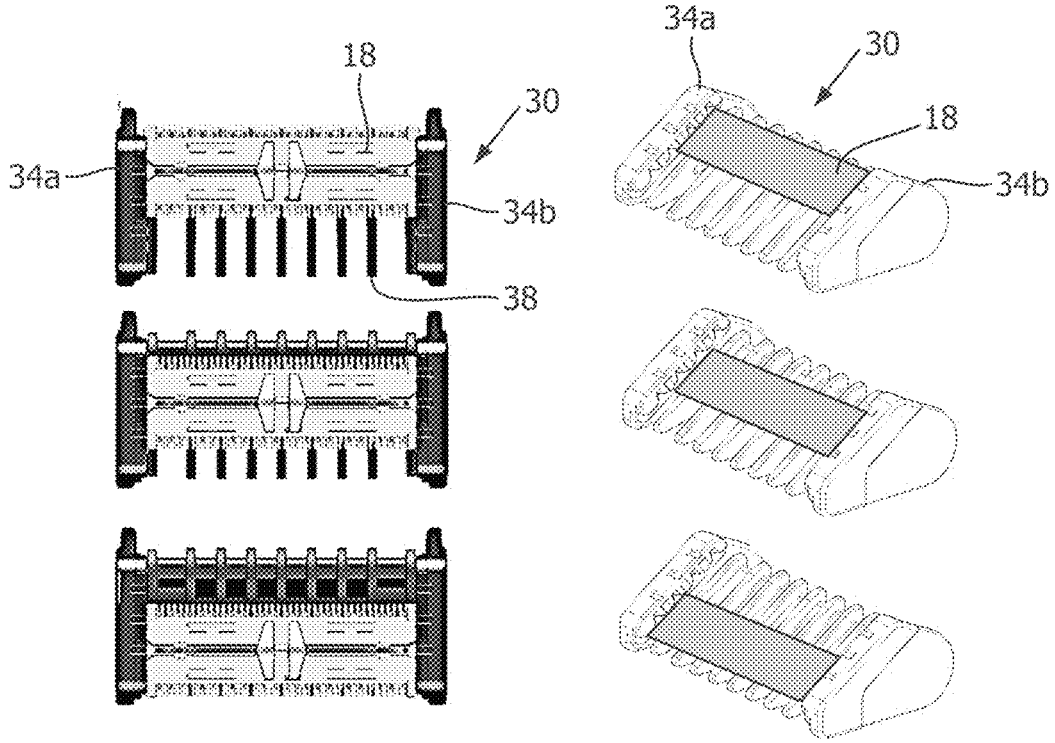
FIG. 7 illustrates movement between different possible straight clamping positions for a cutting element achievable according to one or more embodiments.

FIG. 7 illustrates slidable advancement of a received cutting element 18 between different clamping positions of the attachment comb 30. A left side of the figure shows a plan view of the cutting element received in the different clamping positions. The right side of the figure schematically depicts the corresponding locations of the different clamping positions up and down the sloped clamping plane, as viewed from a perspective view.

Due to the angled slope, each different clamping position along the slope provides for a different hair cutting length in use. As can be seen, the blade can be slid to different positions along the sloped clamping plane, and retained in place by means of the locating notches, to thereby adjust the cutting device between different cutting length settings in use.

Although in the above-described examples, the clamping elements 34*a*, 34*b* are displaced away from one another by a pinching action, in other examples other mechanisms are possible. By way of one example, the two clamping elements may be slidably moved apart from one another, e.g. a slidable release mechanism may be provided between one or both of the clamping elements and the support bar 32, to allow one or both to reversibly slide outwards parallel to the bar. Other possible mechanisms will be apparent to the skilled person.

The notches 54 of the attachment comb 30 define between them at least a plurality of straight clamping positions having the cutting element extending perpendicularly between the clamping elements 34*a*, 34*b*. These different positions define different height settings for the attachment comb 30. Each straight, or perpendicular, clamping position is facilitated by a respective pair of notches, one notch of the pair on the first 34*a* clamping element, the second notch of the pair on the second clamping element, the notches of this pair being aligned with respect to one another along a perpendicular axis between the two clamping elements, e.g. parallel to the support bar 32. The notches of the pair should hence be perpendicularly aligned with one another, such that a perpendicular axis exists extending between the two, meaning an axis that meets at each notch at a right angle, i.e. normal to the notch.

In advantageous embodiments, the notches 54 of the attachment comb may be further configured to define between them a series of slanted clamping positions having a received cutting element 18 extending diagonally between the clamping elements 34*a*, 34*b*. In this set of embodiments, both translational and rotational adjustment of the cutting element between the clamping elements is possible. In a diagonal or slanted clamping position, a cutting element is held between a pair of notches which are perpendicularly offset with respect to one another. Diagonal, or slanted, placement of the cutting element permits fades or fading to be achieved in cut hair, which is an effect in which a height gradient is cut into a line of hair.

To improve facilitation of this functionality, an advantageous configuration for the notches 54 may be provided, which will now be described.

Figure 8:
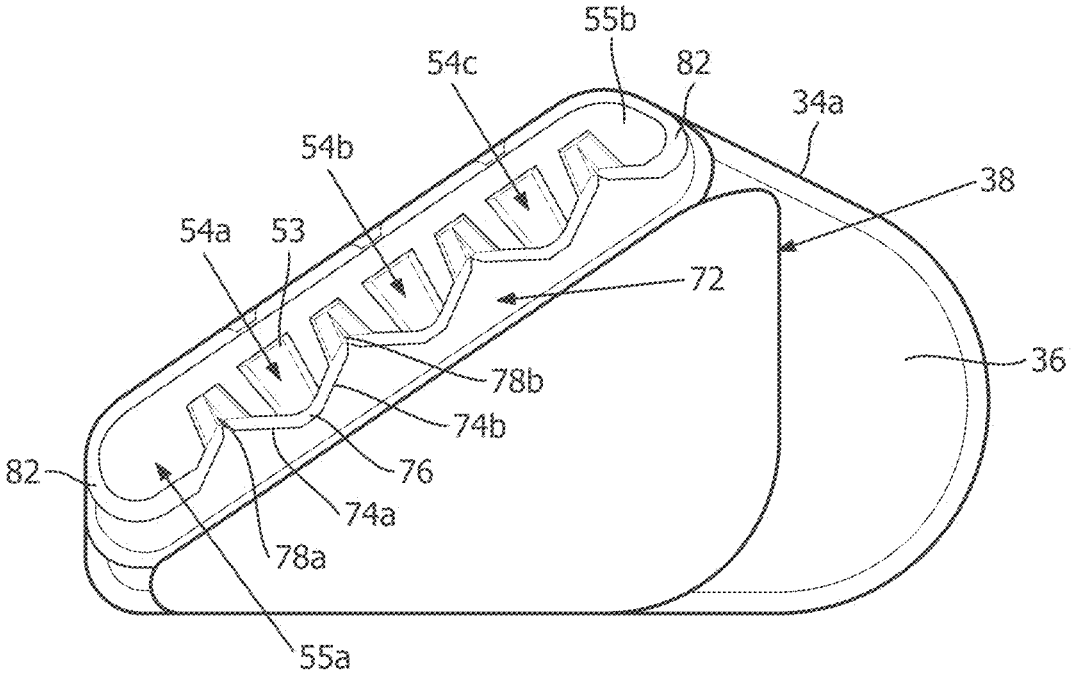
FIG. 8 shows a side elevation of an example notch arrangement for an attachment comb in accordance with one or embodiments.
Figure 9:
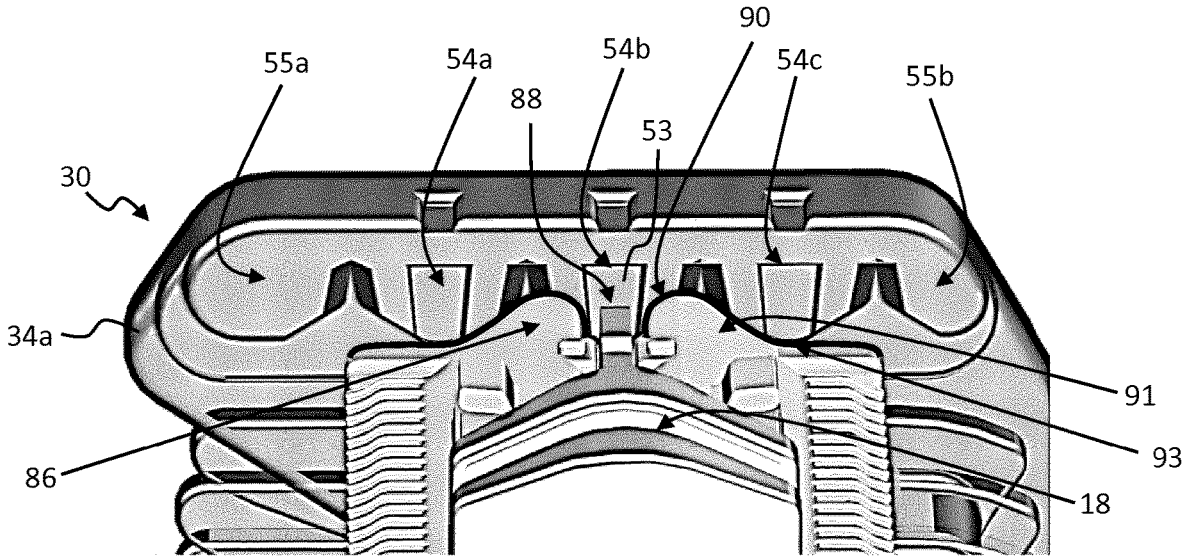
FIG. 9 shows a perspective view of the notch arrangement of FIG. 8 in use, with an engaging part of a cutting element received in one of the notches.
Figure 10:
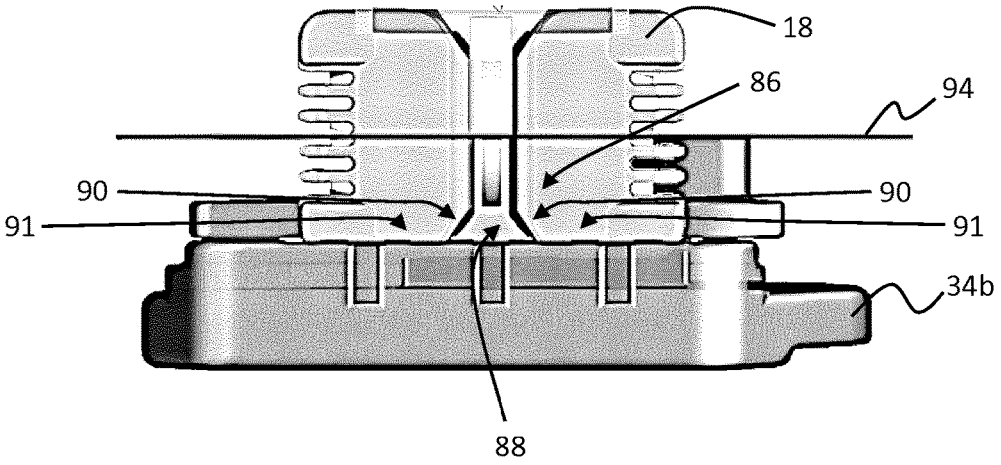
FIG. 10 shows a top-down view of the notch arrangement of FIGS. 8 and 9 in use with an engaging part of a cutting element received in one of the notches.

FIGS. 8-10 illustrate the advantageous notch arrangement in accordance with one or more embodiments.

FIG. 8 illustrates a side elevation of the notch geometry on one of the two clamping elements 34.

FIG. 9 illustrates a perspective view of the notch geometry in use, with a cutting element received within one of the notches.

FIG. 10 shows a top-down view of a clamping element 34 having the notch geometry, with a cutting element received in one of the notches.

With reference to FIG. 8, the advantageous notch arrangement comprises a set of notches 54*a*, 54*b*, 54*c*, 55*a*, 55*b* formed into respective inner faces 36 of each of the clamping elements 34*a*, 34*b* of the attachment comb 30. For simplicity, FIG. 8 shows the notches for only one 34*a* of the two clamping elements. However a corresponding, e.g. identical, set of notches would be provided on the respective inner face of other 34*b* clamping element.

The set of notches 54, 55 is aligned in a row which runs along a slanted axis across the inner face 36. The set of notches 54, 55 on the opposite clamping element 34*b* (not shown) is also aligned in a row running along a parallel and aligned slanted axis, such that the two sets of notches define between them a sloped plane which forms a clamping plane for the cutting element in use.

Furthermore, in the present example, the slanted axis of the line of notches 54, 55 is arranged to run substantially parallel to a slanted plane defined by upper edges 37 of the slanted comb teeth 38 (not shown in FIG. 8). The notches are disposed running therefore substantially parallel and alongside the sloped upper edges 37 of the comb teeth, such that the clamping plane is oriented parallel with the sloped upper surface of the comb teeth. This particular arrangement is not essential however.

The notches define a set of clamping positions for a cutting element 18 which have the cutting element at various positions along the clamping plane defined between the opposed sets of notches. In the present example, and advantageously, the various clamping positions have the cutting element resting at various positions atop said comb teeth 38. An outline of a cross-section through one of the comb teeth 38 is shown in FIG. 8 to illustrate the location of the teeth relative to the notches.

The notches 54, 55 each have a substantially flat back wall surface, the back wall substantially parallel with the plane of the clamping element 34 into which they are formed. The notches further each comprise side walls 74*a*, 74*b* rising outwardly from the back wall in a depth direction of the notch, and wherein interior faces of the side walls (facing inwardly of the notch) extend at an incline with respect to said line along which the notches are arranged. The inner faces of the sidewalls each slope from a lower base wall 76 of the notch, this also rising outwardly of the back face in a depth direction.

Each of the notches 54, 55 is open on one side, in particular an upper or top side, the open top sides all opening directly onto a common channel or path 72 which runs across the tops of all of the notches, linking them together. The connecting channel 72 is slanted, with a slant angle being parallel to the slant along which the notches 54, 55 are aligned, i.e. the channel runs parallel to the line of notches. The channel forms a sliding channel, to permit sliding of received engaging edge parts of a cutting element 18 received within the attachment comb between different notch positions without having to remove the cutting element completely out of the notches or from between the clamping elements 34*a*, 34*b*.

Furthermore the connecting channel 72 not only facilitates translational sliding of engaging end parts of the cutting element 18 up and down the comb, and between clamping positions, but also rotational movement of the cutting element between the clamping elements, to permit movement between one or more diagonal clamping positions.

The main (e.g. planar) body of a received cutting element itself may slide parallel with the region of the clamping element 34*a* between the comb teeth upper edges 37 and the notches 54, 55. The connecting channel 72 referred to above then facilitates simultaneous slidable indexing of the engaging end parts of the cutting element between the notches to thereby facilitate this sliding of the cutting element main body.

The notches 54, 55 and connecting channel 72 may together define or bound a continuous sunken area, about which engaging end parts of a cutting element 18 may freely slide, permitting easy adjustment between both straight (perpendicular) clamping positions, and slanted (diagonal) clamping positions.

The back wall of each of the notches 54 further delimits a recessed panel 53 or strip, sunken into said back wall, and arranged substantially centrally within each notch. This recessed area 53 is for example elongate in dimension, for example with an elongate axis perpendicular to the axis of alignment of the notches 54, 55. The recessed panels may further support locking engagement of an appropriately shaped edge or protrusion of an engaging part of a cutting element, to more securely locate the received cutting element in the notch.

Furthermore, each of the notches 54, 55 comprises at least one inclined interior sidewall 74 which leads toward the connecting channel 72 running above it. The slanted sidewall facilitates easy sliding of an engaging edge part of a cutting element out of the notch and into the sliding channel, or vice versa. The slanted side wall thus may provide a guiding function, guiding an engaging edge part of a cutting element smoothly in and out the respective notch in gradated fashion. Hence the sidewall may effectively form a ramp wall leading from a base interior wall of the respective notch to the common channel.

The side wall also provides a firm supporting wall against which a correspondingly shaped edge of a received engaging part of a cutting element may firmly rest and lock in place.

The arrangement of notches includes a set of primary notches 54*a*, 54*b*, 54*c*, and a pair of end notches 55*a*, 55*b*, the primary notches being aligned between the end notches.

The primary notches 54*a*, 54*b*, 54*c* are for forming clamping positions, i.e. for receiving and locating engaging ends parts of a cutting element in use, to define the clamping positions. The end notches 55*a*, 55*b* are to support the retaining of the cutting element 18 in place when it is in the minimum and maximum primary notch positions, defined by notches 54*a* and 54*c*. For example, a suitable supporting tail or peripheral portion of a cutting element engaging end part may rest in the end notch 55 to provide firm locking support against displacement of the cutting element out of the notch.

Each of the primary notches comprises a pair of inclined interior side walls 74*a*, 74*b*, each leading to the common connecting channel 72. This hence facilitates easy sliding of an engaging end part of a received cutting element 18 in and out of the notch from or in either direction.

The inclined interior sidewalls 74*a*, 74*b* preferably upwardly depend from opposite ends of a flat base wall 76 comprised by each primary notch 54. The base-wall advantageously provides firm support for an engaging part of a received cutting element in use.

The end notches 55*a*, 55*b* are arranged at either end of the line of primary notches 54*a*, 54*b*, 54*c*. The end notches form ends of the line of notches. The end notches each comprise a rounded or curved interior sidewall 82 on one side, the curved sidewall defining an end boundary to the continuously connected line of notches. The curved shape encourages any engaging part of a cutting element which enters the end notch back toward a primary notch, i.e. the curved side-wall is shaped to guide received engaging parts in a direction back to the neighboring primary notch.

Each end notch 55 includes an inclined interior sidewall on an opposite side to the curved sidewall, the inclined sidewall inclined toward the connecting channel 72.

Inclined interior sidewalls 74 of neighboring notches, either primary notches 54 and/or end notches 55 incline toward respective opposite ends of a linking wall section 78 which joins upper ends of neighboring sidewalls together. The linking wall section may be formed by an upper face or edge of an extruded or part-extruded area arranged just above and straddling the two side walls. The linking wall section provides an additional support point upon which an appropriate portion of a received cutting element may rest to further lock it stably into a given clamping position. The linking wall section may be flat for example, or may be comprise a flat portion at an upper-most point of a generally peaked wall.

The arrangement of inclined and flat walls in this notch arrangement provides particularly efficient geometry of supporting edges upon which co-operating edges of an appropriately shaped engaging part of a cutting element may rest and lock in place.

FIGS. 9 and 10 show perspective and plan views of one clamping element 34*a* of an example attachment comb 30 having the notch geometry described and illustrated in FIG. 8, in a clamped position, with an engaging end part 86 of an example cutting element 18 received within one 54*b* of the notches. In this example, the engaging end part 86 at the end of the cutting element has a general u-shaped outline, with a dipped section 88 extending downward toward the middle, and connected first and second curved wall sections 90, 91 extending at either side of this dipped section. The first curved wall section 90 is raised, and the second curved wall section 91 declines downwardly from this raised section. This shape of the engaging end part 86 engages in complementarity with the inclined wall geometry of the arrangement of notches 54.

The different wall sections of the clamping element 18 variously engage with surfaces both of the notch 54*b* in which the clamping element is received, and of neighboring notches 54*a*, 54*b* at either side of this notch. In this way, a particularly secure locking attachment of the cutting element to the attachment comb is provided.

In particular, undersurfaces of the first curved wall sections 90 at either side of the dipped section 88 engage against the linking wall sections 78*a*, 78*b* at either side of the receiving notch 54*b*. The second curved wall sections 91 on either side of the dipped section 88 engage against respective inclined side walls 74*b*, 74*a* of notches 54*a*, 54*b* neighboring the receiving notch 54*b*, at either side. In this way the curved wall sections 90, 91 effectively hug to side surfaces of the notch 54 in which the clamping element is received and the neighboring notches 54*a*, 54*c* either side of this notch, to hold the clamping element firmly within the receiving notch 54*b*.

The dipped section 88 extends downwardly into the notch, and delimits a free space interior of the dip where a cutter driving bar may freely slide in oscillatory fashion back and forth (for driving relative cutting motion of cutter blades of the cutting element). The recessed panel 53 in the back wall of the notch may for example receive an end of the cutting bar in use. A base of the dip engages with the flat base wall 76 of the notch.

The flat base walls 76 of notches 54*a*, 54*c* neighboring that in which the cutting element engaging part 86 is received advantageously act as supporting surfaces for tail sections 93 of the engaging part 86 of the cutting element 18. The tail sections rest engagingly against said base walls to further support locking engagement of the cutting element in the receiving notch 54*b*.

FIG. 10 shows a top down view of the engaging part 86 of the cutting element 18 located in the notch 54*b*. The horizontal line 94 indicates a length-wise truncation of the cutting element, so that only the two end regions of the cutting element are shown.

The first 90 and second 91 curved wall sections and dipped section 88 of the engaging part 86 of the cutting element 18 are indicated.

The geometry described for the engaging part 86 of the cutting element 18 is a geometry found for example on a known cutting element of an existing device: the Philips® OneBlade® trimmer. The dipped section 88 in this case is to accommodate a lateral slot along which a blade of the cutting element laterally slides, e.g. oscillates in use.

As discussed above, the advantageous notch arrangement described above and illustrated in FIGS. 8-10 not only provides clamping positions in which the cutting element 18 extends perpendicularly between the clamping elements 34*a*, 34*b*, but also provides for clamping of the cutting element in diagonal clamping positions between the clamping elements. This is because the combination of inclined interior sidewalls 74 within the notches 54 provides strong sideways-directed (i.e. directed parallel with the clamping elements) support against counter-forces exerted by received edge parts of diagonally disposed cutting elements.

The arrangement of interior side 74 and base 76 walls provides for a strong locking geometry which permits secure fixation of diagonally disposed cutting elements. In addition, the connecting slot 72 allows for orientational adjustment of a cutting element received between the clamping elements without removal of the cutting element from the notch arrangement 54, 55. This allows convenient movement between the diagonal positions. Furthermore, base walls 76 of adjacent notches provide further supporting surfaces against which tail sections 93 of the cutting element engaging part 86 can further firmly engage to further support the clamping element locked in place.

A diagonal cutting element arrangement facilitates creation of fades or fading in cut hair. Fading is a concept known within the field of hair trimming. Fading means creating a gradient in hair length. This faded effect results in a smooth overflow in hair length from no hair to a set hair length. Different possible diagonal clamping positions hence allows for realization of different possible hair length gradient effects in use. This can be combined with the adjustable hair length setting provided by the sloped clamping plane between the notches, to allow for a large number of possible hair cutting settings.

Figure 11:
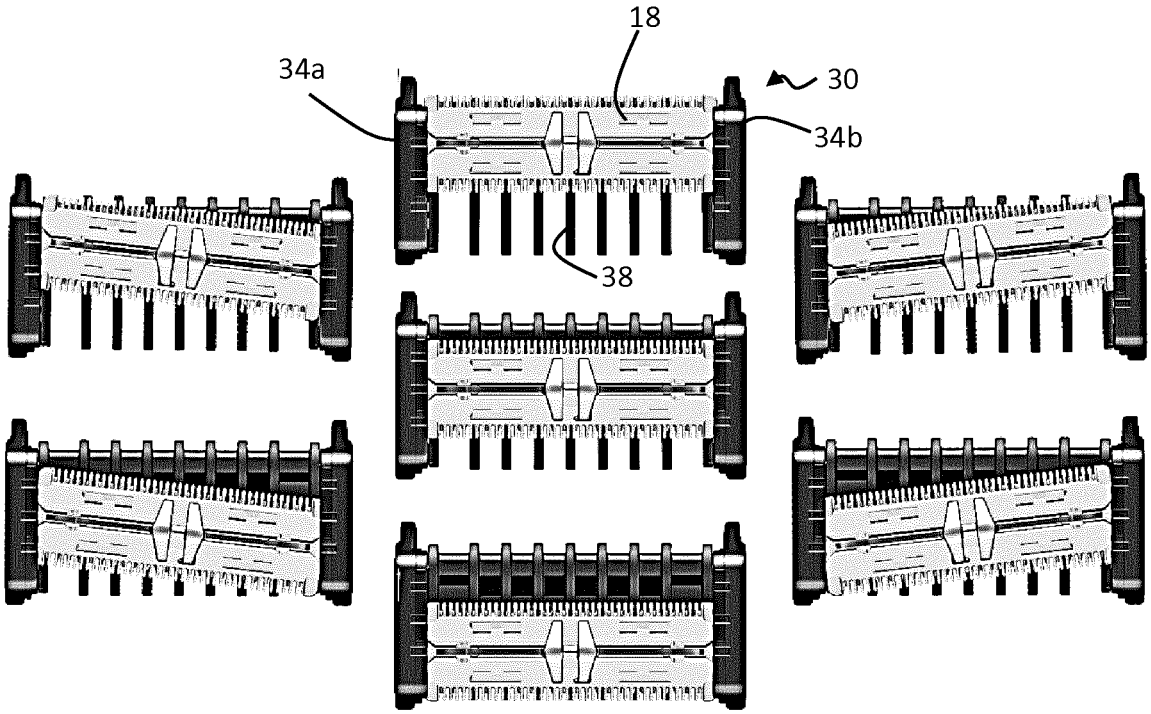
FIG. 11 illustrates movement between different possible straight and slanted clamping positions for a cutting element achievable according to one more embodiments.

FIG. 11 illustrates adjustment of a cutting element 18 in use between different possible linear (i.e. perpendicular) clamping positions and diagonal clamping positions. As can be seen, for each possible diagonal slant angle of the cutting element, multiple possible height settings are achievable. In the present example, having three primary notches 54*a*, 54*b*, 54*c* on each clamping element, each diagonal slant setting can be moved between two different possible height settings. In combination with the three straight clamping position settings, this makes seven possible clamping positions in total.

In general, the total number of possible cutting settings, is linked to the number of possible length settings, i.e. the number of possible perpendicular or straight clamping positions. Denoting the number of possible straight clamping positions as n, the total number of clamping positions, both straight and diagonal, can be expressed as: $n+2*(n-1)$, or equivalently, $3n-2$.

The illustrated example of FIGS. 8-11 defines three different length settings, such that the total number of settings in this case is seven.

According to any embodiment of the present invention, the attachment comb may advantageously be formed as single part, i.e. as a single unitary body, for example by injection molding. Such a single piece unit can be manufactured at low cost. In particular such a unit may in general be manufactured at the same cost as a standard non height-adjustable attachment comb. However, since it can effectively replace a whole set of attachment combs, comprising combs of multiple different (fixed) settings, total equivalent cost price for a consumer is reduced.

Embodiments of the present invention enable trimming at multiple lengths by use of a single part element. Different fade effects are possible in some embodiments through use an advantageous locking notch geometry which allows for clamping a cutting element in different diagonal positions across a set of comb teeth, and also for easy sliding movement of engaging edge parts of a cutting element between different locking positions.

A further aspect of the present invention provide a hair cutting assembly comprising: a hair cutting device having a cutting element; and a releasable attachment comb in accordance with any of the embodiments or examples described above, or in accordance with any claim of this application, for attaching to the hair cutting element.

The cutting device may include engaging parts for engaging with the notches of the releasable attachment comb, with the attachment comb attaching to the cutting device via said engaging parts.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A releasable attachment comb for attachment to a hair cutting device having a cutting element , the attachment comb comprising:

a support frame comprising a support bar , and first and second clamping elements located at respective opposite ends of the support bar, configured to clamp the attachment comb about ends of the cutting element in use;

the first element having a first interior face and the second clamping element having a second interior opposing the first interior face, the first interior face comprising a first set of locating notches, the second interior face comprising a second set of locating notches, each of the first and second set of locating notches being configured to locate engaging parts of respective ends of the cutting element, the first and second set of locating notches defining a clamping plane therebetween;

the attachment comb further comprising an array of comb teeth mounted to the support bar between the first and second clamping elements wherein each comb tooth of the array of comb teeth has a substantially triangular shape, each comb tooth having a rear edge, a skin engaging lower edge, and an upper sloped edge, wherein a first end of the skin engaging lower edge meets with a first end of the rear edge at a rear lower corner of the comb tooth while a second end of the rear edge and a second end of the skin engaging lower edge join to respective ends of the upper sloped edge, the underside lower edge defining a skin engaging contact area;

wherein the first and second set of locating notches define between the first and second set of damping elements, a series of clamping positions for the cutting element, arranged at multiple positions along the clamping plane wherein he clamping plane is sloped with respect to the skin engaging contact area; and wherein the clamping elements are at least partially displaceable away from one another to permit in use release and slidable advancement of the cutting element along the clamping plane between the clamping positions;

wherein the clamping elements are flexible about the support bar to permit bending of an opposed set of first end portions of the clamping elements away from one another, by applying an inward punching action at opposed second end portions of the clamping elements;

wherein the clamping elements form end panels that extend around or encompass the substantially triangular shape of the array of comb teeth; and wherein the series of clamping positions for the cutting element defined by the first and second set of locating notches of the attachment comb cooperatively include a series of slanted clamping positions for holding a received cutting element extending diagonally between the clamping elements, wherein the series of slanted clamping positions defined by the notches are aligned in a row which runs along a slanted axis across the interior face of the clamping elements.

2. The releasable attachment comb as claimed in claim I, wherein at least portions of the support bar connecting to the clamping elements have an elongate cross-section, an elongate length dimension of said cross-section defining a bending axis for each of the clamping elements about the support bar.

3. The releasable attachment comb as claimed in claim 1, wherein the support bar includes reduced cross-section end portions , to which the clamping elements are connected.

4. The releasable attachment comb as claimed in claim 1, wherein the series of clamping positions for the cutting element defined by the first and second set of locating notches of the attachment comb include a series of straight clamping positions for holding a received cutting element extending perpendicularly between the clamping elements.

5. The releasable attachment comb as claimed in claim 1, wherein the first and second set of locating notches on each opposed interior face are arranged in a line.

6. The releasable attachment comb as claimed in claim 5, wherein the notches in each line comprise a top side and a bottom side, wherein the top side opens directly into a common channel running along the tops of the notches and linking the notches together, wherein the channel permits sliding of receiving engaging end parts of the cutting element.

7. The releasable attachment comb as claimed in claim 6, wherein each of the notches has at least one inclined interior side wall leading toward said common channel.

8. The releasable attachment comb as claimed in claim 7, wherein the at least one inclined interior sidewall of each notch leads towards the common channel thereby facilitating sliding of ends of the cutting element in and out of notches and into the common channel, and wherein inclined sidewalls of neighboring notches in each line are connected by a flat linking wall section, extending between upper ends of the said inclined sidewalls of the neighboring notches.

9. The releasable attachment comb as claimed in claim 5 wherein each set of locating notches includes end notches arranged at respective ends of each line of notches, the end notches each having on one side, a rounded side wall formed adjacent to a peripheral edge of the respective first and second elements forming an end to the line, and an inclined interior side wall formed on respective inferior faces of the respective first and second clamping elements, the end notches configured to provide firm locking support against displacement of the cutting element out of an intermediate notch in the line.

10. A method of adjusting a coupling between a hair cutting device having a cutting element and a releasable attachment comb as claimed in claim 1, the method comprising:

at least partially displacing the first and second clamping elements of the attachment comb away from one another by applying an inward pinching action at opposed second end portions of the first and second clamping elements to permit release of the cutting element from a first clamping position;

slidably advancing the cutting element along a clamping plane from the first clamping position towards a second clamping position; and releasing the first and second clamping elements back toward one another to release said partial displacement to thereby lodge and lock the cutting element in the second clamping position.

11. The method as claimed in claim 10, wherein the slidable advancement of the cutting element comprises rotating the cutting element parallel with the clamping plane, so as to move the cutting element to the second clamping position whereby the cutting element extends diagonally between the first and second clamping elements.

12. A hair cutting assembly comprising:

a releasable attachment comb as claimed in claim 1; and a hair cutting device having a cutting element, the cutting device including engaging parts for engaging with notches of the releasable attachment comb, wherein the attachment comb is attached to the cutting device via the engaging parts.

* * * * *